US009874383B2

(12) United States Patent
Jung et al.

(10) Patent No.: US 9,874,383 B2
(45) Date of Patent: Jan. 23, 2018

(54) AIR CONDITIONER

(71) Applicant: LG ELECTRONICS INC., Seoul (KR)

(72) Inventors: Jaehwa Jung, Seoul (KR); Chiwoo Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 236 days.

(21) Appl. No.: 14/790,442

(22) Filed: Jul. 2, 2015

(65) Prior Publication Data

US 2016/0003512 A1 Jan. 7, 2016

(30) Foreign Application Priority Data

Jul. 7, 2014 (KR) ..... 10-2014-0084519

(51) Int. Cl.

| | |
|---|---|
| ***F25B 43/02*** | (2006.01) |
| ***F25B 13/00*** | (2006.01) |
| ***F25B 40/00*** | (2006.01) |
| ***F25B 43/00*** | (2006.01) |
| *F25B 40/02* | (2006.01) |
| *F25B 31/00* | (2006.01) |

(52) U.S. Cl.

CPC ..... *F25B 43/02* (2013.01); *F25B 13/00* (2013.01); *F25B 31/004* (2013.01); *F25B 40/00* (2013.01); *F25B 43/006* (2013.01); *F25B 31/002* (2013.01); *F25B 40/02* (2013.01); *F25B 2400/13* (2013.01); *F25B 2400/23* (2013.01)

(58) Field of Classification Search

CPC ..... F25B 40/02; F25B 31/004; F25B 43/02; F25B 31/002

See application file for complete search history.

(56) References Cited

U.S. PATENT DOCUMENTS

| | | | | |
|---|---|---|---|---|
| 5,603,227 | A | 2/1997 | Holden et al. | |
| 5,899,091 | A | 5/1999 | Fraser et al. | |
| 2012/0055185 | A1* | 3/2012 | Luo | F25B 6/02 62/222 |
| 2013/0219927 | A1* | 8/2013 | Kim | F25B 30/02 62/77 |
| 2015/0107290 | A1* | 4/2015 | Hatomura | F25B 13/00 62/324.6 |

FOREIGN PATENT DOCUMENTS

| | | | |
|---|---|---|---|
| EP | 2383529 | A1 | 11/2011 |
| JP | 2008281265 | A | 11/2008 |
| JP | 2010071614 | A | 4/2010 |
| KR | 1020130096831 | A | 9/2013 |
| WO | 2008/082408 | A1 | 7/2008 |

* cited by examiner

*Primary Examiner* — David Teitelbaum
(74) *Attorney, Agent, or Firm* — Dentons US LLP

(57) ABSTRACT

An air conditioner is provided. The air conditioner includes a compressor for compressing a refrigerant, an oil separator for separating an oil of the refrigerant discharged from the compressor to collect the separated oil into the compressor, a condenser for condensing the refrigerant separated from the oil separator, and a supercooling part in which a main refrigerant that is the refrigerant condensed by the condenser is heat-exchanged with a branch refrigerant branched from the main refrigerant. At least a portion of the oil collected into the compressor passes through the supercooling part.

13 Claims, 4 Drawing Sheets

AIR CONDITIONER

CROSS-REFERENCE TO RELATED APPLICATIONS

The present application claims priority under 35 U.S.C. 119 and 35 U.S.C. 365 to Korean Patent Application No. 10-2014-0084519 (filed on Jul. 7, 2014), which is hereby incorporated by reference in its entirety.

BACKGROUND

The present disclosure relates to an air conditioner.

In general, air conditioners are apparatuses for adjusting an indoor temperature to make a pleasant air environment in an indoor space.

Such an air conditioner includes an indoor unit disposed in an indoor space and an outdoor unit for supplying a refrigerant to the indoor unit. Also, one or more indoor units may be connected to the outdoor unit.

Also, the air conditioner may perform a cooling or heating operation by supplying the refrigerant into the indoor unit. Here, a cooling operation or heating operation that is an operation of the air conditioner is determined according to a flow of the refrigerant. That is, the air conditioner may perform the cooling operation or the heating operation according to a flow of the refrigerant.

First, a flow of the refrigerant when the air conditioner performs the cooling operation is as follows. A refrigerant compressed by a compressor of the outdoor unit is converted into a mid-temperature high-pressure liquid refrigerant by passing through a heat exchanger of the outdoor unit. When the liquid refrigerant is supplied into the indoor unit, the refrigerant may be evaporated while being expanded in a heat exchanger of the indoor unit. Thus, surrounding air of the heat exchanger of the indoor unit decreases in temperature by the evaporation phenomenon. Also, when a fan of the indoor unit rotates, the surrounding air of the heat exchanger of the indoor unit, which decreases in temperature may be discharged into the indoor space.

Second, a flow of the refrigerant when the air conditioner performs the heating operation is as follows. When a high-temperature high-pressure gas refrigerant is supplied from the compressor of the outdoor unit into the indoor unit, the high-temperature high-pressure gas refrigerant may be liquefied in the heat exchanger of the indoor unit. Energy emitted by the liquefaction phenomenon increases a temperature of the surrounding air of the heat exchanger of the indoor unit. Also, when the fan of the indoor unit rotates, the surrounding air of the heat exchanger of the indoor unit, which increases in temperature may be discharged into the indoor space.

The compressor disposed in the outdoor unit may compress the refrigerant to the high-temperature high-pressure gas state. The compressed refrigerant may be discharged together with oil existing in the compressor. Also, the refrigerant and the oil that are discharged from the compressor may be introduced into an oil separator and thus be separated by the oil separator. The oil separated from the oil separator may be collected into the compressor through an oil collection passage.

However, when the oil separated from the oil separator is directly collected into the compressor, the compressor may be deteriorated in efficiency.

SUMMARY

Embodiments provide an air conditioner for cooling oil discharged from an oil separator to a compressor so that the compressor is efficiently driven.

In one embodiment, an air conditioner includes: a compressor for compressing a refrigerant; an oil separator for separating an oil of the refrigerant discharged from the compressor to collect the separated oil into the compressor; a condenser for condensing the refrigerant separated from the oil separator; and a supercooling part in which a main refrigerant that is the refrigerant condensed by the condenser is heat-exchanged with a branch refrigerant branched from the main refrigerant, wherein at least a portion of the oil collected into the compressor passes through the supercooling part.

The air conditioner may further include: an injection passage through which the branch refrigerant flows and in which an injection expansion valve is disposed; and an injection introduction part disposed in the compressor, the injection introduction part being connected to the injection passage, wherein the injection passage may connect the supercooling part to the injection introduction part of the compressor.

The air conditioner may further include: an accumulator for separating a gaseous refrigerant from the refrigerant to supply the separated gaseous refrigerant into the compressor; and an oil collection passage for collecting the oil separated by the oil separator into the compressor, wherein the oil collection passage may be connected to a suction passage extending from the accumulator to the compressor.

The air conditioner may further include a first oil injection passage connecting one position of the oil collection passage to the supercooling part to guide the oil into the supercooling part.

The air conditioner may further include a second oil injection passage connected to the first oil injection passage to discharge the oil cooled in the supercooling part, wherein the second oil injection passage may be connected to a combination part of the injection passage.

The air conditioner may further include an oil opening/closing valve disposed in the first oil injection passage or the second oil injection passage to open or close the first oil injection passage or the second oil injection passage.

In the injection passage, a check valve may be disposed between the combination part of the injection passage and the injection expansion valve, wherein the check valve may prevent the oil flowing through the second oil injection passage from flowing backward toward the injection expansion valve.

The supercooling part may include: a first supercooler for supercooling the main refrigerant; and a second supercooler connected to the first supercooler in series to supercool the main refrigerant.

When a cooling operation is performed, the second supercooler may supercool the main refrigerant that is supercooled in the first supercooler, and when a heating operation is performed, the first supercooler may supercool the main refrigerant that is supercooled in the second supercooler.

In the first supercooler, heat may be exchanged between a first passage through which the main refrigerant flows and a second passage through which the branch refrigerant flows.

The oil separated by the oil separator may be selectively cooled in the second supercooler and collected into the compressor.

In the second supercooler, heat may be exchanged between a third passage through which the main refrigerant flows, a fourth passage through which the branch refrigerant flows, and a fifth passage through which the oil flows.

The injection passage may include: a first injection passage connected to the first supercooler and the first injection introduction part of the compressor; and a second injection passage connected to the second supercooler and the second injection introduction part of the compressor.

The air conditioner may further include: a first oil injection passage connecting the oil separator to the second supercooler; and a second oil injection passage having one end communicating with the second supercooler and the other end combined with the second injection passage.

The air conditioner may further include: a first injection passage for guiding a flow of a first branch refrigerant to the first supercooler and in which a first injection expansion valve is disposed; and a second injection passage for guiding a flow of a second branch refrigerant to the second supercooler and in which a second injection expansion valve is disposed, wherein, when a heating load is less than a set load, the second injection expansion valve may be closed, and the main refrigerant may be heat-exchanged with the oil in the second supercooler.

In another embodiment, an air conditioner includes: a compressor for compressing a refrigerant; an oil separator for separating an oil of the refrigerant discharged from the compressor to collect the separated oil into the compressor; a condenser for condensing the refrigerant separated from the oil separator; and a first supercooler in which heat is exchanged between a main refrigerant which is condensed in the condenser and a first branch refrigerant branched from the main refrigerant; a second supercooler in which heat is exchanged between the main refrigerant passing through the first supercooler and a second branch refrigerant branched from the main refrigerant; an oil collection passage extending from the oil separator to a suction passage of the compressor to collect the oil into the compressor; and an oil injection passage extending from the oil collection passage to the second supercooler.

The oil injection passage may include: a first oil injection passage extending from one position of the oil collection passage to the inside of the second supercooler; and a second oil injection passage connected to the first oil injection passage to discharge the oil that is heat-exchanged in the second supercooler.

The air conditioner may further include: a first injection passage for guiding a flow of the first branch refrigerant and in which a first injection expansion device is disposed; and a second injection passage for guiding a flow of the second branch refrigerant and in which a second injection expansion device is disposed.

The second injection passage may further include: a combination part to which the second oil injection passage is connected; and a check valve disposed at a position between the second injection expansion device and the branch part.

The air conditioner may further include an oil opening/closing valve disposed in the second oil injection passage to selectively restrict a flow of the oil to the second supercooler.

The details of one or more embodiments are set forth in the accompanying drawings and the description below. Other features will be apparent from the description and drawings, and from the claims.

DETAILED DESCRIPTION OF THE EMBODIMENTS

Figure 1:
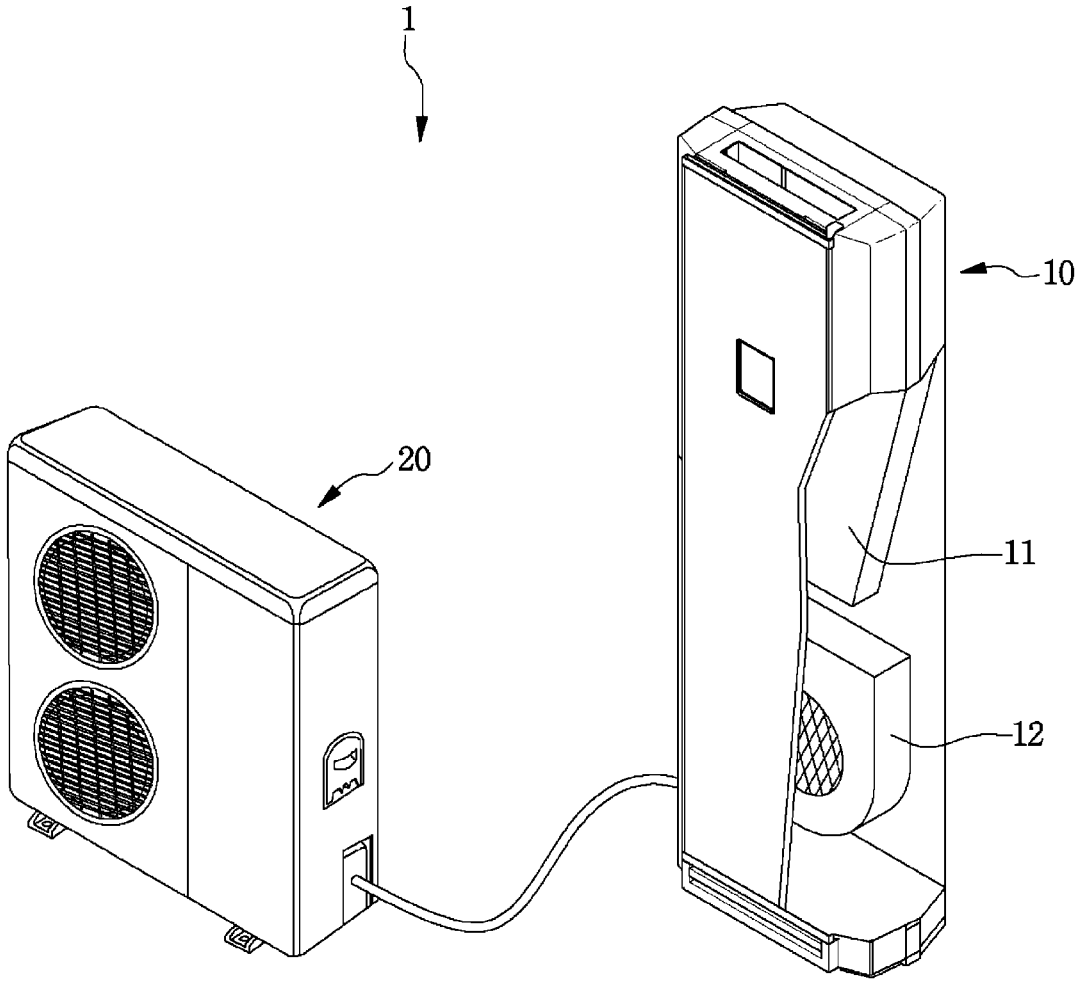
FIG. 1 is a view of an air conditioner according to an embodiment.

Exemplary embodiments of the present disclosure will be described below in more detail with reference to the accompanying drawings. It is also noted that like reference numerals denote like elements in appreciating the drawings even though the same elements are displayed on other drawings. Moreover, detailed descriptions related to well-known functions or configurations will be ruled out in order not to unnecessarily obscure subject matters of the present disclosure.

Also, in descriptions of the elements, terms "a first", "a second", etc and reference symbols "A", "B", "(a)", "(b)", etc may be used. These terms and reference symbols are used only to differentiate one element from the other element. Thus, the order of the elements corresponding to the terms and reference symbols given in the description is not limited thereto. In the following description, it will be understood that when an element is referred to as being "connected", "coupled", or "contact" another element, it can be directly connected or contact, or intervening elements may be also be "connected", "coupled" or "contact" between the elements.

Hereinafter, an air conditioner according to an embodiment will be described with reference to accompanying drawings.

Figure 2:
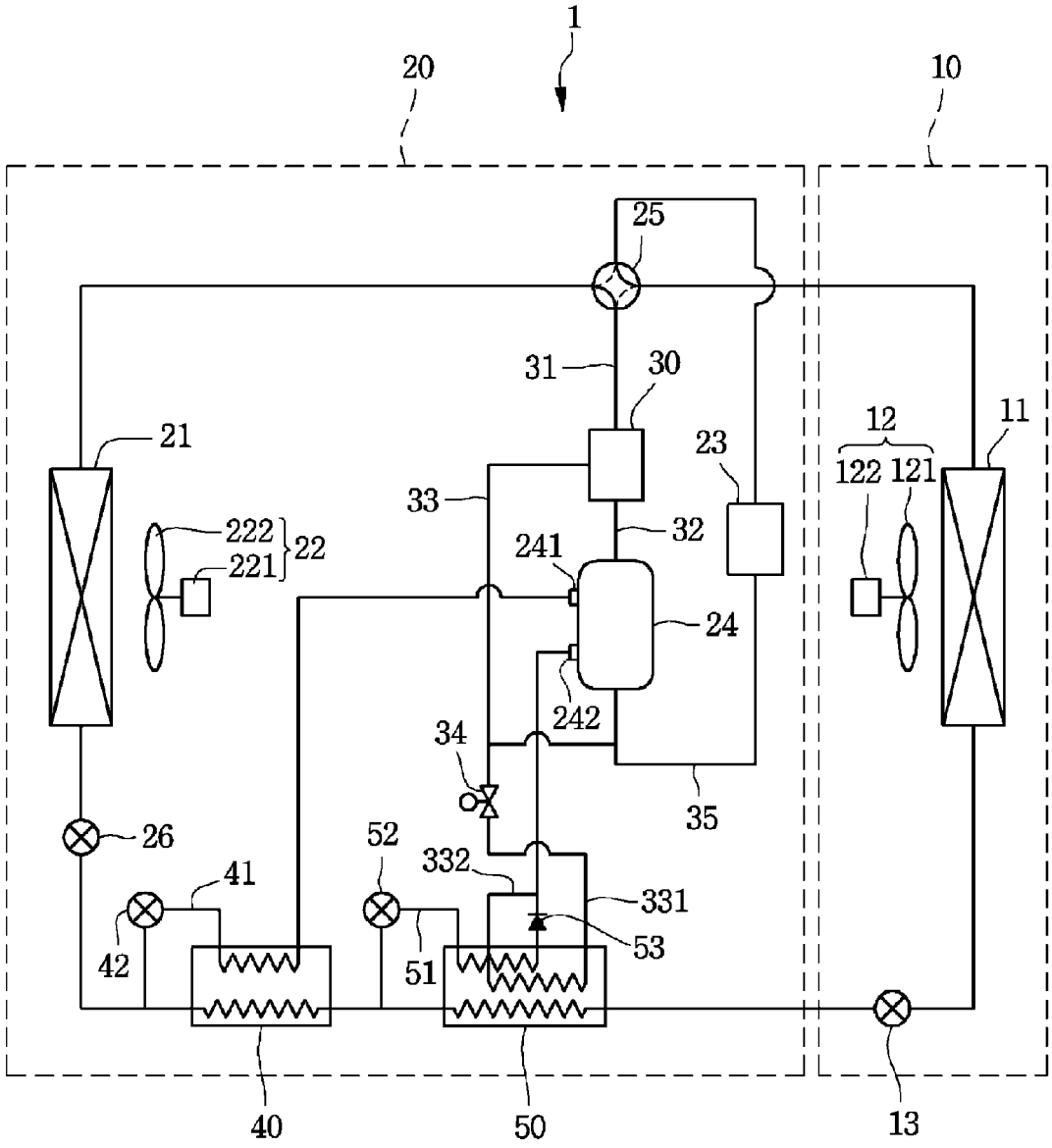
FIG. 2 is a view illustrating a system of the air conditioner of FIG. 1.

FIG. 1 is a view of an air conditioner according to an embodiment, and FIG. 2 is a view illustrating a system of the air conditioner of FIG. 1.

Referring to FIGS. 1 and 2, an air conditioner 1 according to an embodiment includes an indoor unit 10 and an outdoor unit 20. For example, the indoor unit 10 may be a standing type indoor unit. However, the present disclosure is not limited to the indoor unit 10, for example, the indoor unit 10 may be a wall-mounted type or ceiling-type indoor unit.

The indoor unit 10 may discharge heat-exchanged air to an indoor space. Also, the indoor unit 10 is connected to the outdoor unit 20 through a refrigerant tube 27. While a refrigerant circulates through the refrigerant tube 27, a refrigeration cycle of compression-condensation-expansion-evaporation may operate. Also, the air conditioned from the indoor unit 10 may be discharged into the indoor space according to the circulation of the refrigerant. The indoor unit 10 may be provided in plurality, and the plurality of indoor units 10 may be connected to the outdoor unit 20.

The indoor unit 10 may be connected to the outdoor unit 20 through a communication cable to transmit or receive a control command according to a predetermined communication manner.

The air conditioner may further include a remote control device (not shown) for controlling the indoor unit 10 and the outdoor unit 20. Also, the air conditioner may further include a local control device (not shown) that is connected to the indoor unit 10 to receive a command of a user and output an operation spate of the indoor unit 10.

The air conditioner may further include one or more units selected from a ventilation unit, an air cleaning unit, a humidification unit, a dehumidification unit, and a heater in addition to the indoor unit 10 and the outdoor unit 20. Also, a lighting unit and an alarm unit may be connected to be interlocked with the remote control device (not shown) to operate.

An air suction hole to which indoor air is suctioned and a discharge hole from which the air heat-exchanged inside the indoor unit 10 is discharged may be defined in the indoor unit 10. Also, the indoor unit 10 may include a wind direction adjusting unit disposed on the discharge hole. The wind direction adjusting unit may open and close the discharge hole and control a direction of the air discharged from the discharge hole. Also, the indoor unit 10 may adjust an amount of the wind discharged from the discharge hole.

Also, the indoor unit 10 may include a vane disposed in the air suction hole or the air discharge hole. The vane may open and close at least one of the air suction hole and the air discharge hole and guide a flow direction of the air.

Hereinafter, inner systems of the indoor unit and the outdoor unit of the air conditioner will be described.

Referring to FIGS. 1 and 2, the outdoor unit 20 includes an outdoor heat exchanger 21 in which outdoor air is heat-exchanged with the refrigerant, an outdoor blower 22 for blowing the outdoor air to the outdoor heat exchanger 21, an accumulator 23 for separating a gaseous refrigerant, a compressor 24 for compressing the gaseous refrigerant separated from the accumulator 23, and a four-way valve 25 for switching a flow of the refrigerant compressed by the compressor 24.

When the air conditioner 1 performs a cooling operation, the refrigerant compressed by the compressor 24 may pass through the four-way valve 25 and then be guided to the outdoor heat exchanger 21. When the air conditioner 1 performs a heating operation, the compressed refrigerant may pass through the four-way valve 25 and then be guided to the indoor heat exchanger 11. The outdoor unit 20 may further include an outdoor expansion device 26 for decompressing the refrigerant when the air conditioner 1 performs the heating operation. The outdoor expansion device 26 may adjust a flow rate of the refrigerant so as to control a superheating degree or a supercooling degree of the refrigeration cycle. For example, the outdoor expansion device 26 may include an electronic expansion valve (EEV) that is capable of adjusting an opening degree.

The outdoor unit 20 may further include supercooling parts 40 and 50 for supercooling the condensed refrigerant. For example, the supercooling parts 40 and 50 may be disposed between the outdoor heat exchanger 21 and the indoor heat exchanger 11 with respect to a flow direction of the refrigerant when the air conditioner 1 performs the cooling or heating operation.

When the air conditioner 1 performs the cooling operation, the outdoor heat exchanger 21 may act as the condenser for condensing the refrigerant by heat-exchanging with the outdoor air. On the other hand, when the air conditioner 1 performs the heating operation, the outdoor heat exchanger 21 may act as the evaporator for evaporating the refrigerant by heat-exchanging with the outdoor air.

The outdoor blower 22 may include an outdoor motor 221 for generating power and an outdoor fan 222 connected to the outdoor motor 221 to generate a blowing force while rotating by the power of the outdoor motor 221.

The compressor 24 may compress the refrigerant in multi-stages. For example, the compressor 24 may be a scroll compressor in which the refrigerant is compressed by a relative phase difference between a fixture scroll and a rotation scroll.

The indoor unit 10 includes the indoor heat exchanger 11 in which the indoor air is heat-exchanged with the refrigerant, an indoor blower 12 for blowing the indoor air to the indoor heat exchanger 11, and an indoor expansion device 13 for decompressing the refrigerant when the air conditioner 1 performs the cooling operation.

The indoor expansion device 13 may adjust a flow rate of the refrigerant to control the superheating degree or supercooling degree of the refrigeration cycle. For example, the indoor expansion device 13 may include the EEV that is capable of adjusting an opening degree.

When the air conditioner 1 performs the heating operation, the indoor heat exchanger 11 may act as the condenser for condensing the refrigerant by heat-exchanging with the indoor air. On the other hand, when the air conditioner 1 performs the cooling operation, the indoor heat exchanger 11 may act as the evaporator for evaporating the refrigerant by heat-exchanging with the indoor air.

The indoor blower 12 may include an indoor motor 122 for generating power and an indoor fan 121 connected to the indoor motor 122 to generate a blowing force while rotating by the indoor motor 122.

When the air conditioner performs the cooling operation, the gaseous refrigerant may be compressed by the compressor 24 to pass through the four-way valve 25 and be condensed by the outdoor heat exchanger 21 and expanded by the indoor expansion device 13. Then, the expanded refrigerant may be evaporated in the indoor heat exchanger 11.

On the other hand, when the air conditioner performs the heating operation, the refrigerant may be compressed by the compressor 24 to pass through the four-way valve 25 and be condensed by the indoor heat exchanger 11 and expanded by the outdoor expansion device 26. Then, the expanded refrigerant may be evaporated in the outdoor heat exchanger 21.

Hereinafter, the supercooling part when the air conditioner performs the cooling operation will be described in detail.

Figure 3:
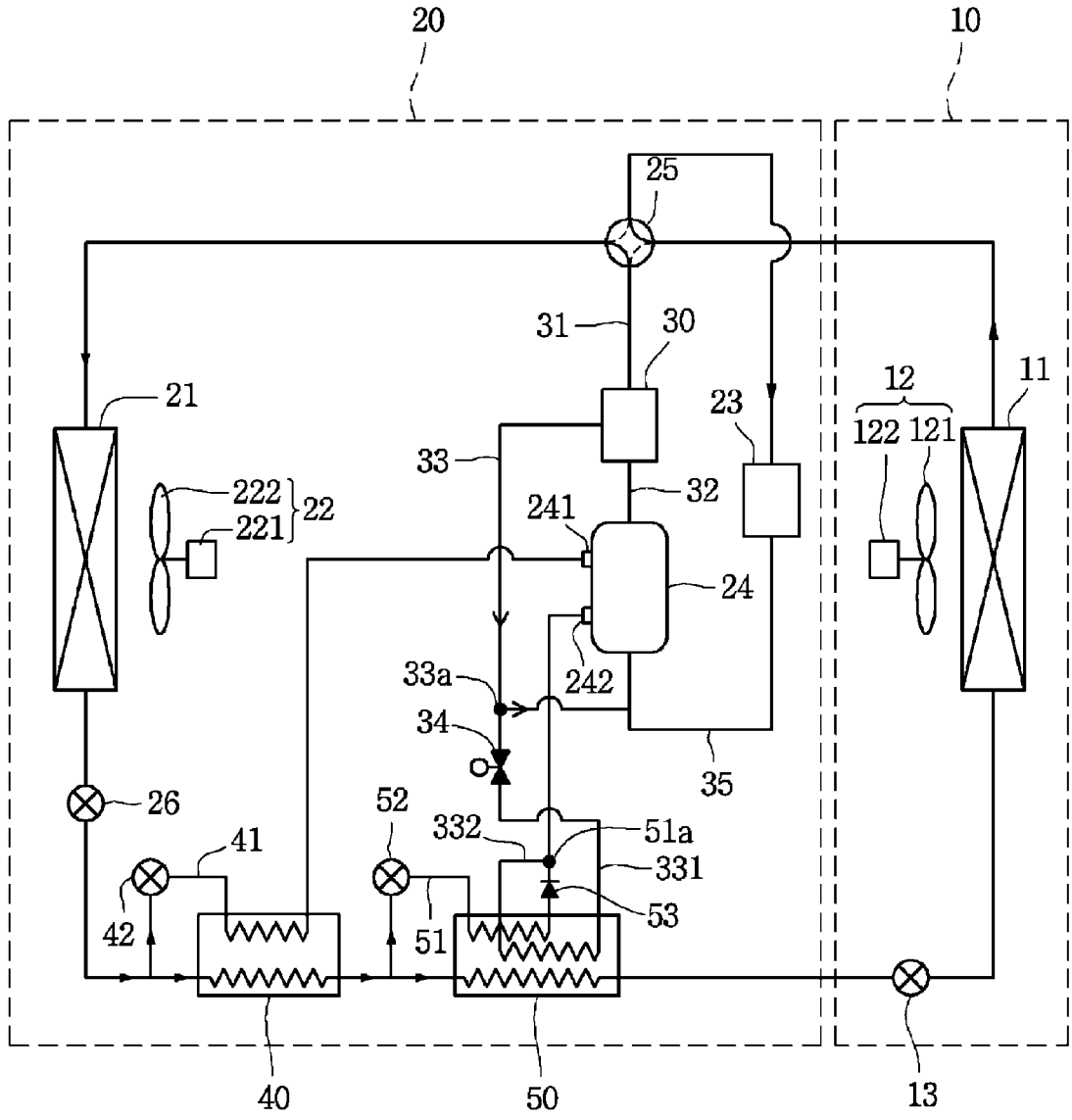
FIG. 3 is a view illustrating a flow of a refrigerant when the system of the air conditioner of FIG. 2 performs a cooling operation.

FIG. 3 is a view illustrating a flow of a refrigerant when the system of the air conditioner of FIG. 2 performs a cooling operation.

Referring to FIG. 3, the supercooling parts 40 and 50 include a first supercooler 40 for supercooling the refrigerant (hereinafter, referred to as a "main refrigerant") passing through the outdoor heat exchanger 21 and a second supercooler 50 for supercooling the refrigerant passing through the first supercooler 40. The first and second supercoolers 40 and 50 are connected to each other in series.

Also, the air conditioner may include a first injection passage 41 for bypassing a portion of the main refrigerant and a first injection expansion valve 42 disposed in the first injection passage 41 to adjust an amount of the bypassed refrigerant. The refrigerant bypassed through the first injection passage 41 may be expanded by the first injection expansion valve 42. For example, the first injection expansion valve 42 may include the EEV.

Here, the refrigerant of the main refrigerant, which is bypassed through the first injection passage 41 may be called a "first branch refrigerant". Also, in the first supercooler 40, the main refrigerant is heat-exchanged with the first ranch refrigerant. In other words, the first supercooler 40 includes a first passage through which the main refrigerant flows and a second passage through which the first branch refrigerant flows therein. Here, heat may be exchanged between the first passage and the second passage.

Since the first branch refrigerant changes into a low-temperature low-pressure refrigerant while passing through the first injection expansion valve 42, the first branch refrigerant may absorb heat while being heat-exchanged with the main refrigerant, and the main refrigerant may dissipate heat to the first branch refrigerant. Thus, the main refrigerant may be supercooled.

Also, the first branch refrigerant passing through the first supercooler 40 may be injected into a first injection introduction part 241 of the compressor 24 through the first injection passage 41. The first injection introduction part 241 is connected to the first injection passage 41 and is disposed on one position of the compressor 24.

The air conditioner may include a second injection passage 51 through which a portion of the main refrigerant passing through the first supercooler 40 is bypassed and a second injection expansion valve 52 disposed in the second injection passage 51 to adjust an amount of the refrigerant bypassed through the second injection passage 51. The refrigerant bypassed through the second injection passage 51 may be expanded by the second injection expansion valve 52. For example, the first injection expansion valve 42 may include the EEV.

Here, the refrigerant bypassed through the second injection passage 51 may be called a "second branch refrigerant". In the second supercooler 50, the main refrigerant is heat-exchanged with the second branch refrigerant. In other words, the second supercooler 50 may include a third passage through which the main refrigerant flows and a fourth passage through which the second branch refrigerant flows. Heat may be exchanged between the third passage and the fourth passage.

Since the second branch refrigerant changes into a low-temperature low-pressure refrigerant while passing through the second injection expansion valve 52, the second branch refrigerant may absorb heat while being heat-exchanged with the main refrigerant, and the main refrigerant may dissipate heat to the second branch refrigerant. Thus, the main refrigerant may be supercooled.

Also, the second branch refrigerant passing through the second supercooler 50 may be injected into a second injection introduction part 242 of the compressor 24 through the second injection passage 51. The second injection introduction part 242 is connected to the second injection passage 51 and is disposed on the other position of the compressor 24. That is, the second and first introduction parts 242 and 241 may be connected to positions of the compressor 24 different from each other.

Hereinafter, an oil separator will be described in detail.

When the air conditioner operates, the high-temperature high-pressure gaseous refrigerant compressed by the compressor 24 may be introduced into an oil separator 30 along an introduction passage 32 together with oil discharged from the compressor. The refrigerant mixed with the oil, which is introduced into the oil separator 30 may be separated into a refrigerant and oil. Here, the refrigerant separated in the oil separator 30 may be discharged to a discharge passage 31 and thus be condensed in the condenser.

Also, the oil separated in the oil separator 30 may move along an oil collection passage 33. The oil collection passage 33 is connected to a suction passage 35 extending from the accumulator 23 to the compressor 24.

Thus, the oil introduced along the oil collection passage 33 may be mixed with the gaseous refrigerant passing through the suction passage 35 and then be suctioned into the compressor 24.

The air conditioner may include a first oil injection passage 331 connecting the oil collection passage 33 to the second supercooler 50. The first oil injection passage 331 extends from one position 33*a* of the oil collection passage 33 to an inside of the second supercooler 50. The first oil injection passage 331 may allow at least one portion of the oil flowing through the oil collection passage 33 to bypass to the second supercooler 50.

The second supercooler 50 includes a third passage through which the main refrigerant flows, a fourth passage through which the second branch refrigerant flows, and a fifth passage through which the oil flows. Here, heat may be exchanged among the third, fourth, and fifth passages. Here, the fifth passage corresponds to the first oil injection passage 331. While the heat is exchanged among the third, fourth, and fifth passages, the oil may be cooled.

Also, the air conditioner may include a second oil injection passage 332.

The second oil injection passage 332 may have one end that is connected to the first oil injection passage 331 of the second supercooler 50 and the other end that is connected to a combination part 51*a* of the second injection passage 51. That is, the second oil injection passage 332 communicates with the first oil injection passage 331 to guide the oil introduced into the second supercooler through the first oil injection passage 331 so that the oil is discharged outside the second supercooler 50.

The combination part 51*a* is disposed on one position of the second injection passage 51, which extends toward a discharge-side of the second supercooler 50. The oil cooled in the second supercooler 50 may successively pass through the second oil injection passage 332 and the second injection passage 51 and thus be introduced into the compressor 24.

In the second injection passage 51, a check valve 53 disposed between the combination part 51*a* of the second injection passage 51 and the second injection expansion valve 52 to guide a flow of the second branch refrigerant of the second injection passage 51 in one direction may be disposed.

The check valve 53 may allow the flow of the refrigerant flowing from the second injection expansion valve 52 to the combination part 51*a* and prevent the oil flowing in the second oil injection passage 332 from flowing backward toward the second injection expansion valve 52.

Also, the air conditioner may include an oil opening/closing valve 34 disposed in the first oil injection passage 331 to open and close the first oil injection passage 331.

When the oil opening/closing valve 34 closes the first oil injection passage 331, the oil separated in the oil separator 0 may pass through the oil collection passage 33 and be mixed with the gaseous refrigerant passing through the suction passage 35 and thus be introduced into the compressor 24.

On the other hand, when the oil opening/closing valve 34 opens the first oil injection passage 331, the oil separated in the oil separator 30 may successively pass through the oil collection passage 33 and the first oil injection passage 331 and be cooled in the second supercooler 50. Then, the oil may successively pass through the second oil injection passage 332 and the second injection passage 51 and be injected into the second injection introduction part 242 of the compressor 24.

Another embodiment is proposed.

The oil opening/closing valve 34 may be disposed in the second oil injection passage 332 to open and close the second oil injection passage 332.

Further another embodiment is proposed.

A reversing valve may be disposed on a position 33*a* where the oil is bypassed from the oil collection passage 33 into the first oil injection passage 331.

When the reversing valve is disposed on the position 33*a* where the oil is bypassed from the oil collection passage 33 into the first oil injection passage 331, the oil separated in the oil separator 30 may be changed in flow direction depending on a control state of the reversing valve.

That is, when the reversing valve is in a first control state, all of oil separated from the oil separator 30 may be mixed with the gaseous refrigerant passing though the suction passage 35 and be introduced into the compressor 24. On the other hand, when the reversing valve is in a second control state, all of oil separated from the oil separator 30 may be cooled in the second supercooler 50 to successively pass the second oil injection passage 332 and the second injection passage 51 and thus be injected into the second injection introduction part 242 of the compressor 24.

Hereinafter, a process in which the oil separated in the oil separator is cooled and introduced into the compressor when the air conditioner performs the heating operation will be described.

Figure 4:
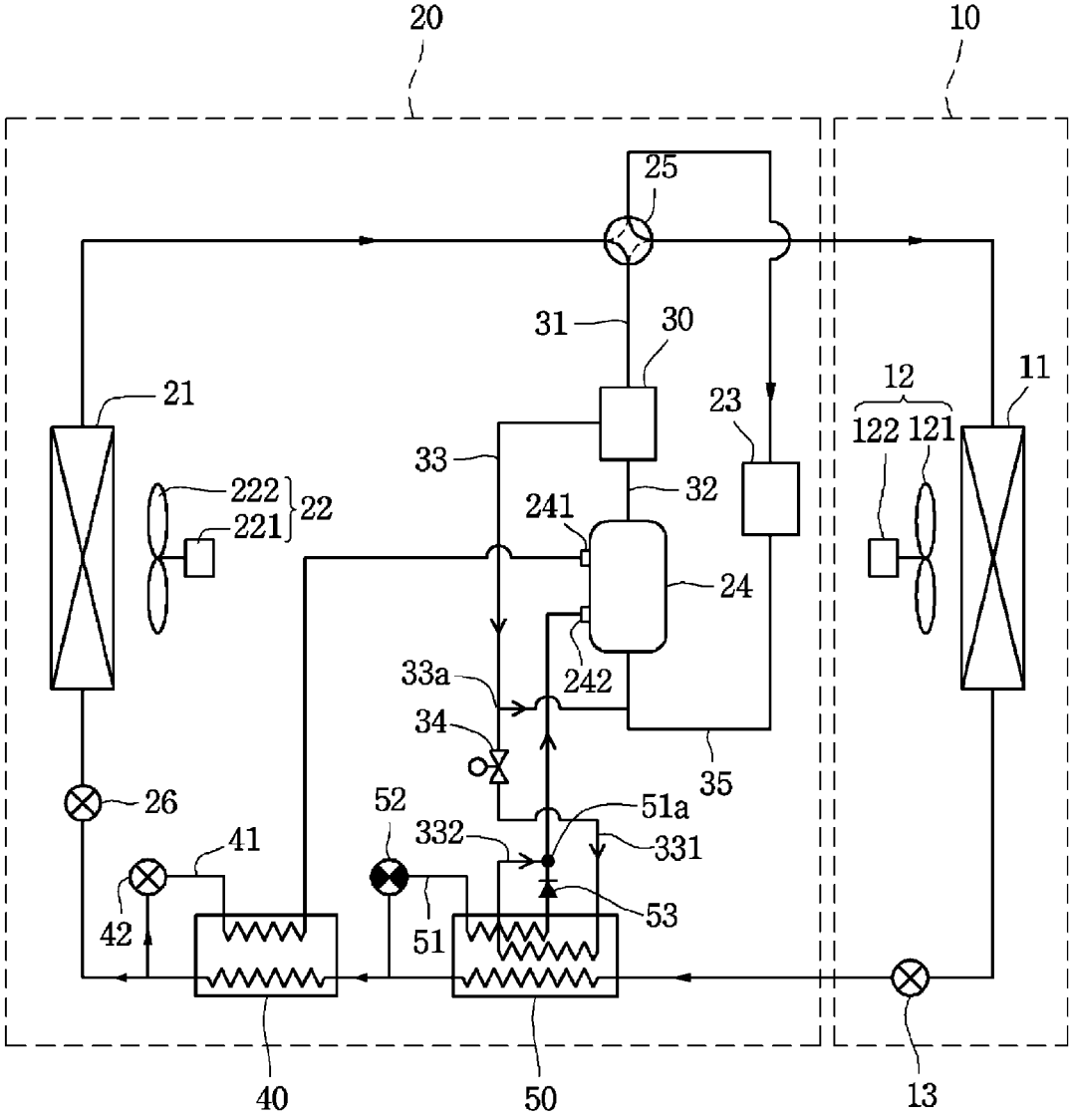
FIG. 4 is a view illustrating a flow of a refrigerant when the system of the air conditioner of FIG. 2 performs a heating operation.

FIG. 4 is a view illustrating a flow of a refrigerant when the system of the air conditioner of FIG. 2 performs a heating operation. When the air conditioner performs the heating operation, operations of the supercooling parts 40 and 50 may be changed on the basis of a heating load. The heating load may be determined on the basis of an operation frequency of the compressor 24. For example, when the heating load is greater than a set load, the compressor 24 may have an operation frequency greater than a set frequency. Also, when the heating load is less than the set load, the compressor 24 may have an operation frequency less than the set frequency.

In detail, referring to FIG. 4, when the air conditioner requires the heating load, that is, when the heating load is greater than the set load, the refrigerant may be supercooled in the first supercooler 40 and the second supercooler 50.

In more detail, the refrigerant that is compressed in the compressor 24 and condensed in the indoor heat exchanger 11 may be successively supercooled in the second supercooler 50 and the first supercooler 40 to flow into the outdoor heat exchanger 21. Here, the refrigerant condensed in the indoor heat exchanger 11 may be called a "main refrigerant". Also, the main refrigerant that is successively supercooled in the second supercooler 50 and the first supercooler 40 may be evaporated in the outdoor heat exchanger 21 to flow into the compressor 24.

However, when the air conditioner does not require the heating load, that is, when the heating load is greater than the set load, the main refrigerant does not have to be supercooled in both of the second supercooler 50 and the first super cooler 40. That is, the air conditioner of the present disclosure may selectively operate the first supercooler 40 and the second supercooler 50 which are included in the supercooling parts 40 and 50 to adjust a supercooling degree of the main refrigerant in response to cooling and heating load.

For example, when the second injection expansion valve 52 blocks the second injection passage 51, the main refrigerant may not be supercooled in the second supercooler 50 but be supercooled only in the first supercooler 40 by being heat-exchanged with the first branch refrigerant.

When the oil introduced into the compressor 24 is low-temperature oil, the oil in the compressor may be improved in cooling performance or sealing performance, and thus the compressor 24 may be improved in efficiency. Thus, the oil separated in the oil separator 30 has to be cooled.

Therefore, when the oil opening/closing valve 34 opens the first oil injection passage 331, the oil separated in the oil separator 30 may successively pass through the oil recovery passage 33 and the first oil injection passage 331 to flow into the second supercooler 50. Also, the oil may be heat-exchanged with the main refrigerant condensed in the indoor heat exchanger 11 and thus be cooled in the second supercooler 50.

The oil cooled by the second supercooler 50 may successively pass through the second oil injection passage 332 and the second injection passage 51 and be injected into the second injection introduction part 242 of the compressor 24.

On the other hand, when the second injection expansion valve 52 blocks the second injection passage 51, the main refrigerant is not branched into the second injection passage 51. Thus, the main refrigerant may not be supercooled in the second supercooler 50.

Shortly, when the heating load of the air conditioner is not large, the oil separated in the oil separator 30 may be cooled in the second cooler 50 and injected into the compressor 24. Thus, the compressor may be improved in efficiency.

The air conditioner may selectively operate the plurality of supercoolers included in the supercooling parts to adjust the supercooling degree of the condensed refrigerant in response to the cooling and heating load.

Also, a portion or the whole of oil introduced into the compressor may be cooled to improve the driving efficiency of the compressor.

In detail, when the heating load required in the system is low, since the oil separated from the oil separator is cooled in the supercooler and introduced into the compressor, the compressor may be improved in efficiency.

Also, since the oil is directly injected into the compressor, the refrigerant leakage may be prevented when the compressor operates at the low operation frequency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a compressor for compressing and discharging a refrigerant;

an oil separator for separating an oil from the refrigerant discharged from the compressor, wherein the separated oil is collected back in the compressor;

a condenser for condensing the refrigerant remaining after oil separation by the oil separator; and a supercooling part in which a condensed refrigerant from the condenser is heat-exchanged with a branch refrigerant, wherein the branch refrigerant is branched from the condensed refrigerant, wherein the supercooling part comprises a first supercooler for supercooling the condensed refrigerant; and a second supercooler connected to the first supercooler in series to supercool the condensed refrigerant passing through the first supercooler, wherein heat is exchanged in the first supercooler between a first passage through which the condensed refrigerant flows and a second passage through which the branch refrigerant flows, and wherein heat is exchanged in the second supercooler between a third passage through which the condensed refrigerant flows, a fourth passage through which the branch refrigerant from the condensed refrigerant flows, and a fifth passage through which the oil flows.

2. The air conditioner according to claim 1, wherein the second passage connects the first supercooler to a first injection introduction part on the compressor, and the fourth passage connects the second supercooler to a second injection introduction part on the compressor.

3. The air conditioner according to claim 1 further comprising:

an accumulator for separating a gaseous refrigerant from the refrigerant and supplying the separated gaseous refrigerant back to the compressor; and an oil collection passage for collecting and guiding the oil separated by the oil separator back into the compressor, wherein the oil collection passage is connected to a suction passage extending from the accumulator to the compressor.

4. The air conditioner according to claim 3, wherein the fifth passage connects one position of the oil collection passage to the second supercooler to guide the oil collected by the oil collection passage into the second supercooler, wherein the oil collected and guided into the second supercooler is cooled by the second supercooler.

5. The air conditioner according to claim 4, further comprising a second oil injection passage connected to the fifth passage to discharge the oil cooled in the second supercooler, wherein the second oil injection passage is connected to a combination part of the fourth passage.

6. The air conditioner according to claim 5, wherein a check valve is disposed in the injection passage between the combination part of the fourth passage and an injection expansion valve disposed in the fourth passage, wherein the check valve prevents the oil flowing in the second oil injection passage from flowing backward toward the injection expansion valve.

7. The air conditioner according to claim 1, wherein, when a cooling operation is performed, the second supercooler supercools the condensed refrigerant that is supercooled in the first supercooler, and when a heating operation is performed, the first supercooler supercools the condensed refrigerant that is supercooled in the second supercooler.

8. The air conditioner according to claim 1, wherein the oil separated by the oil separator is selectively cooled in the second supercooler and collected in the compressor.

9. The air conditioner according to claim 1, further comprising:

a first oil injection passage connecting the oil separator to the second supercooler; and a second oil injection passage, wherein the second oil injection passage has two ends, and wherein one end communicates with the second supercooler and the other end combines with the second injection passage.

10. An air conditioner comprising:

a compressor for compressing and discharging a refrigerant;

an oil separator for separating an oil from the refrigerant discharged from the compressor, wherein the separated oil is collected back in the compressor;

a condenser for condensing the refrigerant remaining after oil separation by the oil separator; and a first supercooler in which heat is exchanged between a condensed refrigerant from the condenser and a first branch refrigerant branched from the condensed refrigerant;

a second supercooler in which heat is exchanged between the condensed refrigerant passing through the first supercooler and a second branch refrigerant branched from the condensed refrigerant;

an oil collection passage extending from the oil separator to a suction passage of the compressor to collect the separated oil in the compressor; and an oil injection passage extending from the oil collection passage to the second supercooler, wherein the oil injection passage comprises:

a first oil injection passage extending from one position of the oil collection passage to the second supercooler; and a second oil injection passage connected to the first oil injection passage to discharge the oil that is heat-exchanged in the second supercooler.

11. The air conditioner according to claim 10, further comprising:

a first injection passage for guiding a flow of the first branch refrigerant and in which a first injection expansion device is disposed; and a second injection passage for guiding a flow of the second branch refrigerant and in which a second injection expansion device is disposed.

12. The air conditioner according to claim 11, wherein the second injection passage further comprises:

a combination part to which the second oil injection passage is connected; and a check valve disposed between the second injection expansion device and the branch part.

13. The air conditioner according to claim 10, further comprising an oil opening/closing valve disposed in the second oil injection passage to selectively restrict a flow of the oil to the second supercooler.

* * * * *